US009761400B2

(12) United States Patent
Cho

(10) Patent No.: US 9,761,400 B2
(45) Date of Patent: Sep. 12, 2017

(54) APPARATUS FOR AUXILIARY CONTACT OF CIRCUIT BREAKER

(71) Applicant: LSIS CO., LTD., Anyang-si, Gyeonggi-do (KR)

(72) Inventor: Hyungeun Cho, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/997,398

(22) Filed: Jan. 15, 2016

(65) Prior Publication Data

US 2016/0284500 A1 Sep. 29, 2016

(30) Foreign Application Priority Data

Mar. 24, 2015 (KR) ..... 10-2015-0040873

(51) Int. Cl.

| | |
|---|---|
| ***H01H 71/10*** | (2006.01) |
| ***H01H 71/46*** | (2006.01) |
| *H01H 1/26* | (2006.01) |
| *H01H 13/52* | (2006.01) |

(52) U.S. Cl.

CPC ..... *H01H 71/10* (2013.01); *H01H 71/465* (2013.01); *H01H 1/26* (2013.01); *H01H 13/52* (2013.01); *H01H 2205/002* (2013.01)

(58) Field of Classification Search

CPC .... H01H 2221/016; H01H 3/46; H01H 71/10; H01H 71/465; H01H 1/26

USPC ..... 200/332.1, 334, 337, 400, 293, 318

See application file for complete search history.

(56) References Cited

FOREIGN PATENT DOCUMENTS

| | | | |
|---|---|---|---|
| DE | 29508610 | 8/1995 | |
| EP | 1998352 | 12/2008 | |
| KR | 200467568 | * 6/2013 | ..... H01H 71/465 |

OTHER PUBLICATIONS

European Patent Office Application Serial No. 15203040.9, Search Report dated Aug. 1, 2016, 6 pages.

Korean Intellectual Property Office Application Serial No. 10-2015-0040873, Office Action dated Sep. 22, 2016, 5 pages.

* cited by examiner

*Primary Examiner* — Edwin A. Leon
*Assistant Examiner* — Ahmed Saeed
(74) *Attorney, Agent, or Firm* — Lee, Hong, Degerman, Kang & Waimey

(57) ABSTRACT

An apparatus for auxiliary contact of a circuit breaker includes a frame, a fixed contactor fixed to the frame inside the frame, a movable contactor installed inside the frame to be contacted with or separated from the fixed contactor, and a contact control member installed inside the frame, the contact control member being formed in a straight line shape, the contact control member being pressurized upward as an overcurrent is applied to the circuit breaker to allow the movable contactor to be contacted with or separated from the fixed contactor.

4 Claims, 3 Drawing Sheets

APPARATUS FOR AUXILIARY CONTACT OF CIRCUIT BREAKER

CROSS-REFERENCE TO RELATED APPLICATIONS

Pursuant to 35 U.S.C. §119(a), this application claims the benefit of earlier filing date and right of priority to Korean Patent Application No. 10-2015-0040873, filed on Mar. 24, 2015, the contents of which are incorporated by reference herein in its entirety.

BACKGROUND OF THE DISCLOSURE

1. Field of the Disclosure

The present disclosure relates to an apparatus for auxiliary contact of a circuit breaker, and more particularly, to an apparatus for auxiliary contact of a circuit breaker, which can improve the reliability in displaying, to the outside, a normal or overcurrent state of the circuit breaker through the apparatus, reduce the manufacturing cost of the apparatus and simplify the entire structure of the apparatus by reducing the number of components used in the apparatus, and prevent components from being easily broken in the use of the apparatus.

2. Description of the Conventional Art

In general, a circuit breaker refers to a device for opening/closing a load or interrupting current when there occurs an accident such as earthing or short circuit in a transmission & sub-station system or an electrical circuit. Also, a circuit breaker, in which a circuit breaking part is insulated by an insulator and assembled, may generally manually open or close a line in use or may open or close the line from a remote area through an electrical manipulator, or the like, outside a metal container. Also, when there occurs an overload or short-circuit, the circuit breaker automatically cuts off the line to protect an electric power system and a load device.

In a circuit breaker as described above, a fixed contactor and a movable contactor are installed in a circuit breaking part. The fixed contactor and the movable contactor are contacted with each other to allow current to flow therethrough. In addition, when a large current flows due to a defect of the circuit breaker, the movable contactor is rapidly separated from the fixed contactor, thereby interrupting current.

Meanwhile, a circuit breaker may be classified into an air operation method, a hydraulic operating method, a spring operation method, and the like according to the way in which a circuit breaking part is operated. A circuit breaker may also be classified into an air circuit breaker (ACB) that extinguishes arc by blowing air, a gas circuit breaker (GCB) that extinguishes arc by blowing gas, and the like, according to the way in which arc generated when a movable contactor is separated from a fixed contactor by manipulating a circuit breaking part is extinguished.

In a circuit breaker as described above, a separate apparatus for auxiliary contact is generally installed in a circuit breaking part. The apparatus refers to an apparatus that transmits signals to the outside according to opening/closing of a circuit breaking part, i.e., connection and interruption between a fixed contactor and a movable contactor.

Meanwhile, FIG. 1 is a configuration view showing a conventional apparatus for auxiliary contact of a circuit breaker. FIG. 2 is a configuration view showing a state in which a state of the apparatus when the circuit breaker is in a normal state. FIG. 3 is a configuration view showing a state in which the apparatus is pressurized as an overcurrent is applied to the circuit breaker.

As shown in FIGS. 1 to 3, components of the apparatus are provided inside a frame 10. The apparatus is configured to include a fixed contactor 12, a screw portion 11 fixing the fixed contactor 12, a movable contactor 13 contacted with or separated from the fixed contactor 12, a crossbar 14 moving upward the movable contactor 13, the crossbar 14 having a spring 16 provided therein, a lever 15 formed under the crossbar 14.

According to the configuration described above, if an overcurrent is applied to the circuit breaker, the movable contactor 13 is contacted with or separated from the fixed contactor 12 as the lever 15 and the crossbar 14 move upward, thereby displaying a state of the circuit breaker to the outside.

However, in the conventional apparatus, the movable contactor 13 is provided inside the frame 10 in a state in which the movable contactor 13 is bent to a predetermined angle. Hence, when the movable contactor 13 returns to the original position in the state in which the movable contactor 13 moves upward through the crossbar 14, a restoring force corresponding to bending of the movable contactor 13 through the crossbar 14, in addition to self-bending of the movable contactor 13, has influence on the movable contactor 13. As such, there exist many factors having influence on contact or separation between the movable contactor 13 and the fixed contactor 12. Therefore, if the conventional apparatus is used for a long time, operational characteristics of the apparatus are changed, and as a result, a malfunction of the apparatus frequently occurs.

Also, the crossbar 14 and the lever 15 which move upward the movable contactor 13 are not formed as one component but separately formed, and hence the number of components is increased. Therefore, the manufacturing cost of the apparatus is increased, and the structure of the apparatus is complicated.

Also, a separate crossbar 14 should be manufactured and used according to the structure of the movable contactor 13 and the fixed contactor 12.

SUMMARY OF THE DISCLOSURE

Therefore, an aspect of the detailed description is to provide an apparatus for auxiliary contact of a circuit breaker, which can improve the reliability in displaying, to the outside, a normal or overcurrent state of the circuit breaker through the apparatus, reduce the manufacturing cost of the apparatus and simplify the entire structure of the apparatus by reducing the number of components used in the apparatus, and prevent components from being easily broken in the use of the apparatus.

To achieve these and other advantages and in accordance with the purpose of this specification, as embodied and broadly described herein, an apparatus for auxiliary contact of a circuit breaker includes: a frame; a fixed contactor fixed to the frame inside the frame; a movable contactor installed inside the frame to be contacted with or separated from the fixed contactor; and a contact control member installed inside the frame, the contact control member being formed in a straight line shape, the contact control member being pressurized upward as an overcurrent is applied to the circuit breaker to allow the movable contactor to be contacted with or separated from the fixed contactor.

In one exemplary embodiment, the movable contactor may be located to be inclined inside the frame.

In one exemplary embodiment, the fixed contactor may include a first fixed contactor and a second fixed contactor, and the movable contactor may include a first movable contactor located over the first fixed contactor and a second movable contactor located under the second fixed contactor, so that when the circuit breaker is in a normal state, the first movable contactor is contacted with the first fixed contactor and the second movable contactor is separated from the second fixed contactor, and when an overcurrent is applied to the circuit breaker, the first movable contactor is separated from the first fixed contactor and the second movable contactor is contacted with the second fixed contactor.

In one exemplary embodiment, the contact control member may include a body portion located inside the circuit breaker to move up/down, and a moving plate provided at both sides of the body portion to allow the movable contactor to be contacted with or separated from the fixed contactor by moving the movable contactor as the body portion moves. The length of one side of the moving plate in a direction perpendicular to the moving direction of the body portion may be shorter than the length between the outer side surface of the body portion and the fixed contactor.

In one exemplary embodiment, the moving plate may be located to be adhered closely to an inner surface of the frame before the body portion is pressurized upward.

According to the apparatus of the present disclosure, the movable contactor is formed in the straight line shape and located to be inclined inside the auxiliary contact, so that when the movable contactor is contacted with or separated from the fixed contactor through the contact control member, the movable contactor is influenced by only self-bending thereof without any influence of other components, thereby minimizing factors having influence on operational characteristics in contact or separation between the movable contactor and the fixed contactor. Thus, it is possible to prevent a state of the circuit breaker from being differently displayed to the outside due to a malfunction of the apparatus.

Also, since the movable contactor is formed in the straight line shape, the movable contactor can be easily manufactured as compared with when the movable contactor is used in its bent state. Thus, it is possible to prevent inferior products from being mass-produced in manufacturing of the movable contactor and simplify the manufacturing process of the movable contactor.

Also, the contact control member moving the movable contactor is integrally formed as one component, so that the number of components is decreased. Thus, it is possible to reduce the manufacturing cost of the apparatus and simplify the structure of the apparatus.

Also, the contact control member is formed as one component, and the moving plate is also formed at a lower portion of the contact control member. Thus, one contact control member can be used in various structures without separately manufacturing contact control members according to structures of the movable contactor and the fixed contactor.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWING

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF EXEMPLARY EMBODIMENTS

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
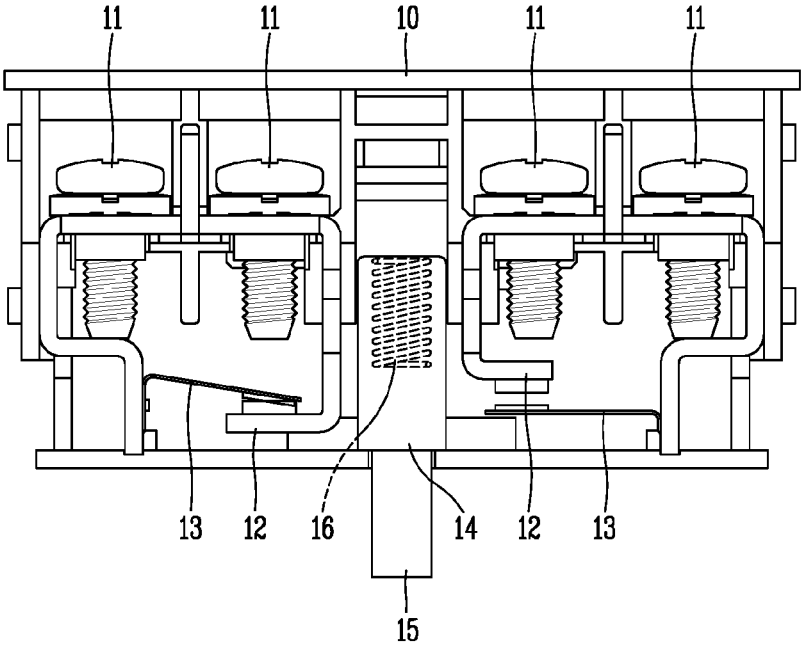
FIG. 1 RELATED ART
FIG. 1 is a configuration view showing a conventional apparatus for auxiliary contact of a circuit breaker.
Figure 2:
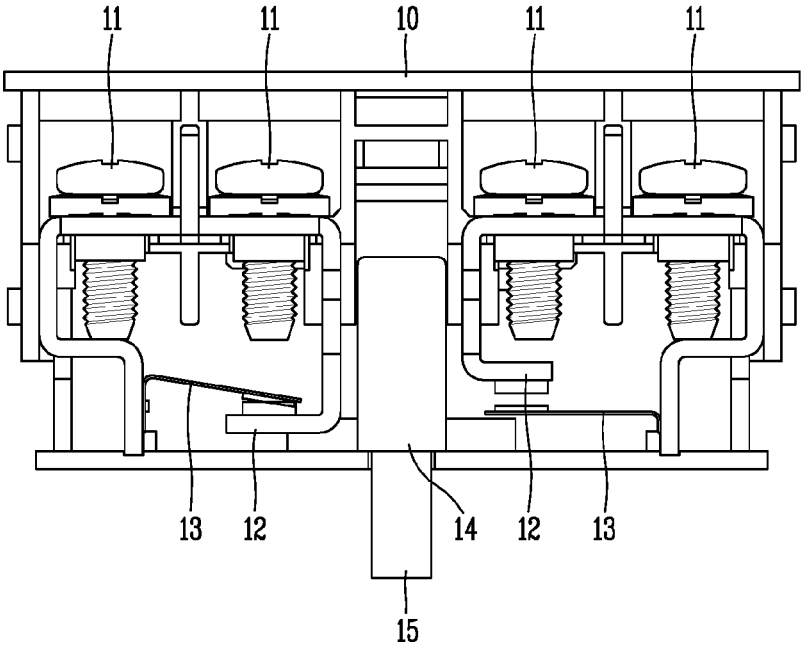
FIG. 2 RELATED ART
FIG. 2 is a configuration view showing a state in which a state of the apparatus when the circuit breaker is in a normal state.
Figure 3:
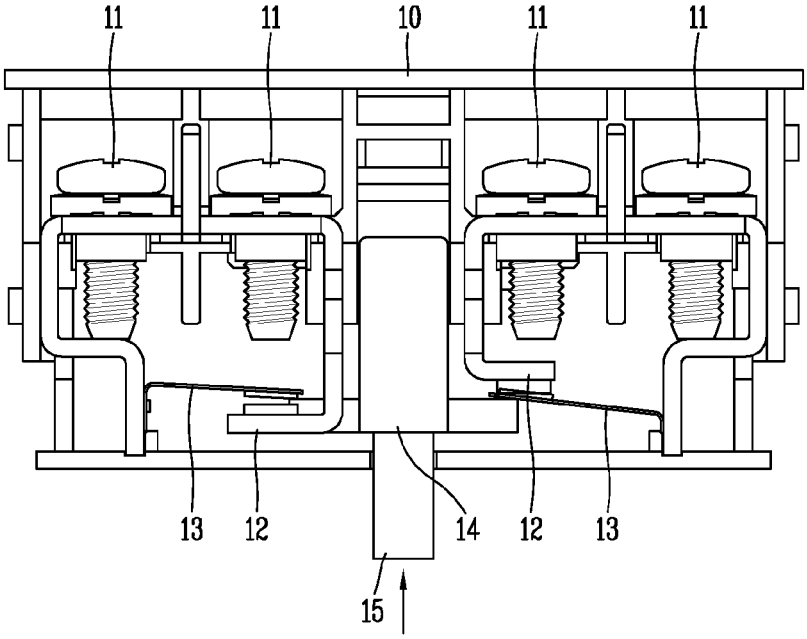
FIG. 3 RELATED ART
FIG. 3 is a configuration view showing a state in which the apparatus is pressurized as an overcurrent is applied to the circuit breaker.
Figure 4:
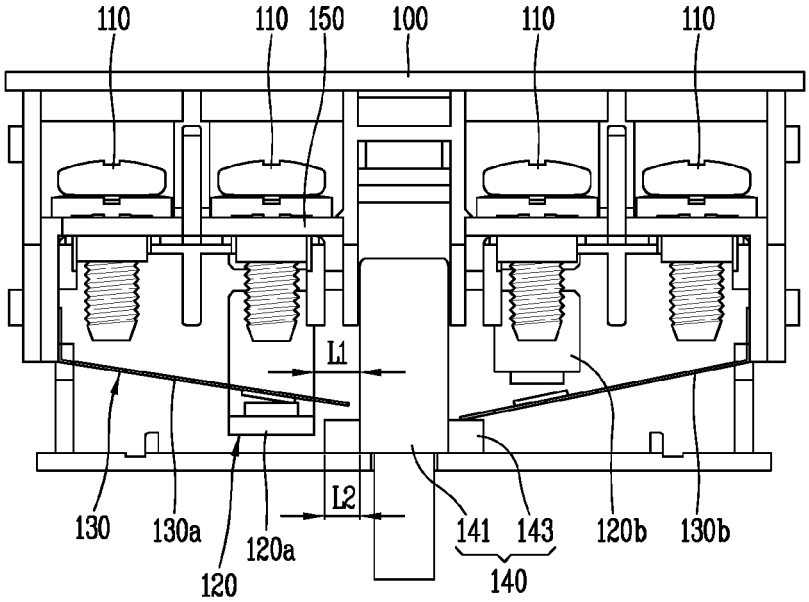
FIG. 4 is a configuration view showing a state of an apparatus for auxiliary contact of a circuit breaker when the circuit breaker is in a normal state according to an exemplary embodiment.
Figure 5:
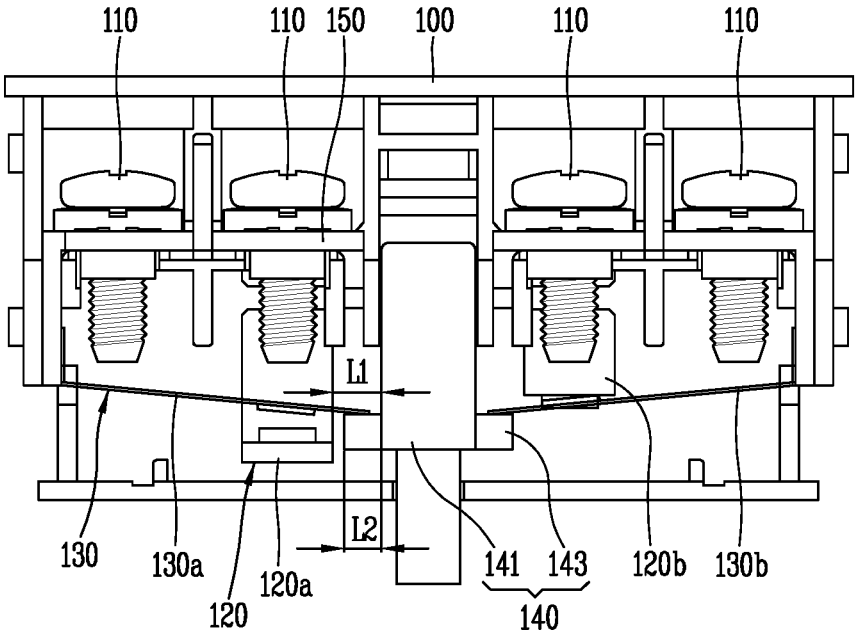
FIG. 5 is a configuration view showing a state in which the apparatus is pressurized as an overcurrent is applied to the circuit beaker according to the exemplary embodiment.

FIG. 4 is a configuration view showing a state of an apparatus for auxiliary contact of a circuit breaker when the circuit breaker is in a normal state according to an exemplary embodiment. FIG. 5 is a configuration view showing a state in which the apparatus is pressurized as an overcurrent is applied to the circuit beaker according to the exemplary embodiment.

As shown in FIGS. 4 and 5, in the apparatus according to the exemplary embodiment, components are provided inside a frame 100.

In this case, a fixed contactor 120, a movable contactor 130, a screw portion 110, a contact control member 140, and the like are provided inside the frame 100.

The fixed contactor 120 is integrally formed with a fixing plate 150 inside the frame 100 to be fixed to the fixing plate 150 through the screw portion 110 passing through the fixing plate 150. Thus, the fixed contactor 120 is contacted with or separated from the movable contactor 130, thereby displaying a state of the circuit breaker to the outside.

In this case, the fixed contactor 120 includes a first fixed contactor 120*a* and a second fixed contactor 120*b*. The first fixed contactor 120*a* and the second fixed contactor 120*b* are located both sides of the contact control member 140.

The movable contactor 130 is formed in a straight line shape, and located to be inclined in a state in which one side of the movable contactor 130 is fixed to an inner surface of the frame 100. Thus, the movable contactor 130 is contacted with or separated from the fixed contactor 120 as the contact control member 140 moves up/down, thereby displaying a state of the circuit breaker to the outside.

In this case, the movable contactor 130 includes a first movable contactor 130*a* and a second movable contactor 130*b*. The first movable contactor 130*a* is located over the first fixed contactor 120*a*, and the second movable contactor

130*b* is located under the second fixed contactor 120*b*. Thus, the first movable contactor 130*a* is contacted with or separated from the first fixed contactor 120*a* through the contact control member 140, and the second movable contactor 130*b* is contacted with or separated from the second fixed contactor 120 through the contact control member 140.

In the conventional art, the movable contactor 130 is contacted with or separated from the fixed contactor 120 as the contact control member 140 moves up/down in a state in which the movable stator 130 is provided in the apparatus to be bent to a predetermined angle. Hence, it is difficult to manufacture the apparatus by adjusting the bending of the movable contactor 130 without any error such that the operation of the auxiliary contact is smoothly performed. Also, the movable contactor 130 is contacted with or separated from the fixed contactor 120 as the contact control member moves in a state in which the movable contactor 130 is bent to an extent. Hence, if the apparatus is used for a long time, the movable contactor 130 is easily deformed, and therefore, operational characteristics of the movable contactor 130 and the fixed contactor 120 are easily changed. However, in the present disclosure, the movable contactor 130 is formed in a straight line shape so as not to be bent, so that it is possible to prevent an error from occurring in manufacturing of the apparatus.

Also, the movable contactor 130 is not only formed to have the straight line shape but also located to be inclined. Thus, when the movable contactor 130 returns to the original position in a state in which the movable contactor 130 is bent upward by being pressurized through the contact control member 140, the movable contactor 130 is influenced by only self-bending thereof, so that it is possible to prevent operational characteristics of the apparatus from being easily changed when the movable contactor 130 and the fixed contactor 120 are contacted with or separated from each other.

Meanwhile, the contact control member 140 is provided inside the frame 100. Thus, if an overcurrent is applied to the circuit breaker, the contact control member 140 is pressurized to push the movable contactor 130 while moving upward, so that the movable contactor 130 is contacted with or separated from the fixed contactor 120.

In this case, the contact control member 140 includes a body portion 141 and a moving plate 143. The body portion 141 is provided inside the frame 100 to move up/down inside the frame 100, and the moving plate 143 is integrally formed with the body portion 141 at both sides of the body portion 141, to allow the movable contactor 130 to be contacted with or separated from the fixed contactor 120 while moving up/down as the body portion 141 moves.

More specifically, before an overcurrent is applied to the circuit breaker, a front lower surface of the second movable contactor 130*b* is contacted with one upper end of the moving plate 143, and a front end of the first movable contactor 130*a* is located at the other side of the moving plate 143 to be upwardly spaced apart from the moving plate 143.

In this state, the first movable contactor 130*a* is contacted with the first fixed contactor 120*a*, and the second movable contactor 130*b* is separated from the second fixed contactor 120*b*.

After that, if the contact control member 140 is pressurized to move upward as an overcurrent is applied to the circuit breaker, the first movable contactor 130*a* and the second movable contactor 130*b* are moved upward by the moving plate 143. Thus, the first movable contactor 130*a* is separated from the first fixed contactor 120*a*, and the second movable contactor 130*b* is contacted with the second fixed contactor 120*b*, thereby displaying, to the outside, whether the overcurrent has been applied to the circuit breaker.

Meanwhile, the moving plate 143 is located to be adhered closely to a bottom surface of the frame 100 before the contact control member 140 is pressurized upward. The length L2 of one side of the moving plate 143 in a direction perpendicular to the moving direction of the body portion 141 is formed shorter than the length L1 between the outer side surface of the body portion 141 and the fixed contactor 120.

In the conventional art, the apparatus is configured such that the movable contactor is moved in the state in which the lever is inserted into the crossbar at a lower portion of the crossbar, and therefore, a plurality of components are used to move the movable contactor. However, in the present disclosure, the contact control member is not formed with a plurality of components but integrally formed as one component. Thus, it is possible to decrease the number of components used in the apparatus and simplify the structure of the apparatus.

The moving plate 143 is located to be adhered closely to the bottom surface of the frame 100 before the moving plate 143 is pressurized, and the length L2 of one side of the moving plate 143 in a direction perpendicular to the moving direction of the body portion 141 is formed shorter than the length L1 between the outer side surface of the body portion 141 and the fixed contactor 120. Thus, the one contact control member 140 can be used in various structures without using contact control members separately formed according to structures of the movable contactor 130 and the fixed contactor 120, thereby reducing the manufacturing cost of the apparatus.

In the present disclosure configured as described above, when the circuit breaker is in a normal state, the moving plate 143 is adhered closely to the bottom surface of the frame 100 in the state in which the contact control member 140 is not pressurized. If an overcurrent is applied to the circuit breaker, the contact control member 140 is pressurized upward, so that the movable contactors 130*a* and 130*b* located at both the sides of contact control member 140 are moved through the moving plate 143 to be contacted with or separated from the fixed contactors 120*a* and 120*b*.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An apparatus for auxiliary contact of a circuit breaker, the apparatus comprising:

a frame;

a fixed contactor installed inside the frame;

a movable contactor that is installed inside the frame and configured to contact or separate from the fixed contactor; and a contact control member installed inside the frame and formed in a straight line shape such that the contact control member is pressurized upward as an overcurrent is applied to the circuit breaker in order to cause the movable contactor to contact the fixed contactor, wherein the contact control member includes a body portion that is located inside the circuit breaker and configured to move up and down, and a movable plate provided at both sides of the body portion to cause the movable contactor to contact or separate from the fixed contactor by moving the movable contactor as the body portion moves, and wherein a length of one side of the movable plate in a direction perpendicular to a moving direction of the body portion is shorter than a length between an outer side surface of the body portion and the fixed contactor.

2. The apparatus of claim 1, wherein the movable contactor is inclined inside the frame.

3. The apparatus of claim 1, wherein:

the fixed contactor includes a first fixed contactor and a second fixed contactor;

the movable contactor includes a first movable contactor located over the first fixed contactor and a second movable contactor located under the second fixed contactor;

the first movable contactor contacts the first fixed contactor and the second movable contactor separates from the second fixed contactor when the circuit breaker is in a normal state; and the first movable contactor separates from the first fixed contactor and the second movable contactor contacts the second fixed contactor when an overcurrent is applied to the circuit breaker.

4. The apparatus of claim 1, wherein the moving plate is adhered closely to an inner surface of the frame before the body portion is pressurized upward.

* * * * *